US006145502A

United States Patent [19]

Lyons et al.

[11] Patent Number: 6,145,502

[45] Date of Patent: Nov. 14, 2000

[54] DUAL MODE OF OPERATION FIREPLACES FOR OPERATION IN VENTED OR UNVENTED MODE

[75] Inventors: David Charles Lyons, Red Wing; Robb Edward Bennett, Jordan; Ronald John Shimek, Prior Lake; Bradley Dean Determan, Lakeville, all of Minn.

[73] Assignee: Heat-N-Glo Fireplace Products, Inc., Lakeville, Minn.

[21] Appl. No.: 09/257,743

[22] Filed: Mar. 2, 1999

[51] Int. Cl.[7] ..... F24C 3/00; F24C 15/32

[52] U.S. Cl. ..... 126/512; 126/516; 126/521; 126/531

[58] Field of Search ..... 126/512, 92 R, 126/92 AC, 515, 516, 521, 531; 431/125

[56] References Cited

U.S. PATENT DOCUMENTS

| | | | |
|---|---|---|---|
| 1,884,746 | 10/1932 | Kline et al. | 126/92 AC |
| 4,233,955 | 11/1980 | McCallum et al. | 126/521 |
| 4,319,556 | 3/1982 | Schwartz et al. | 126/289 |
| 4,330,503 | 5/1982 | Allaire et al. | 126/289 |
| 4,373,507 | 2/1983 | Schwartz et al. | 126/289 |
| 4,793,322 | 12/1988 | Shimek et al. | 126/512 |
| 4,862,869 | 9/1989 | Hazard | 126/77 |
| 5,127,392 | 7/1992 | Mizuno et al. | 126/92 R |
| 5,678,534 | 10/1997 | Fleming | 126/512 |
| 5,738,084 | 4/1998 | Hussong | 126/512 |
| 5,839,428 | 11/1998 | Schroeter et al. | 126/512 |
| 5,906,197 | 5/1999 | French et al. | 126/512 |
| 5,934,268 | 8/1999 | Onocki | 126/512 |

FOREIGN PATENT DOCUMENTS

| | | | |
|---|---|---|---|
| 2200800 | 9/1997 | Canada | 126/512 |
| 375470 | 6/1990 | European Pat. Off. . | |

*Primary Examiner*—Ira S. Lazarus
*Assistant Examiner*—Sara Clarke
*Attorney, Agent, or Firm*—John B. Sowell ATY

[57] ABSTRACT

A novel dual mode of operation gas fireplace of the type having a combustion chamber box and a heat exchanger is provided with a burner in the bottom of the combustion chamber box which creates exhaust gasses to be passed out of the combustion chamber box and into or through the heat exchanger portion of the fireplace mounted on top of or back of the combustion chamber box. The hot exhaust gasses leaving the combustion chamber box may be directed into an exhaust stack or diverted directly into the room to be heated by a blower motor which diverts hot exhaust gas products from the heat exchanger directly into a room area to be heated in a ventless mode of operation. When the blower motor which diverts the exhaust gasses into the room is deactivated, the novel fireplace may be operated in a vented mode of operation. The feature of the present invention is that the novel fireplace may be operated in both the dual modes of operation simultaneously to achieve greater efficiencies than could be achieved by operating the fireplace in a vented mode of operation alone.

22 Claims, 5 Drawing Sheets

DUAL MODE OF OPERATION FIREPLACES FOR OPERATION IN VENTED OR UNVENTED MODE

BACKGROUND OF THE INVENTION

1. Field of the Invention

The present invention relates to vented and unvented fireplaces. More particularly, the present invention relates to novel fireplaces that are operable in either vented and/or unvented modes of operation.

2. Description of the Prior Art

It is well known that unvented gas fireplaces and heaters are capable of killing the occupants of a house. The condition can be described as heating a house with the exhaust gas from an automobile or a gas stove.

When the combustion products of gas fireplaces are inefficient, an excess amount of carbon monoxide (CO) builds up which results in carbon monoxide poisoning that can result in death or permanent brain damage.

It has been proposed to provide efficient burning unvented fireplaces which create less CO in the combustion products. However, the problem still exists that some CO is produced and will continue to build inside the house as long as the unvented gas fireplace is operated. The situation is analogous to a well known gas stove which burns gasses with highly efficient blue flames yet are also well known to produce CO build up which results in brain damage and death of occupants of a house.

For the above reasons, the American National Standards Institute (ANSI) has required that all unvented fireplaces be provided with an oxygen depletion thermocouple actuated switch at or near the gas pilot or burners on unvented fireplaces. Such oxygen depletion sensors shut down the gas valve to the burner system, thus, requiring restart of the system. Such sensors are located in the fireplace at the pilot of the burner and can only detect the oxygen depletion situation of the air entering the combustion chamber.

While no standard has been adopted for the requirement of CO detectors, such detectors are available and operate independent of a unvented fireplace and are usually installed in some remote area away from the fireplace.

It would be much better to detect an oxygen depletion or CO condition before any human damage can possibly occur and shut down a fireplace burner system which is creating the problem. It would be better yet to sense the CO level of the hot air that is being supplied to the room being heated by an unvented fireplace and restrict the level of the CO to a safe level so that no build up of CO is possible in the area being heated.

SUMMARY OF THE INVENTION

It is a principle object of the present invention to provide fireplace units that may be operated in vented and/or unvented modes of operation which cannot build up an unsafe CO level in a room area being heated.

It is a principle object of the present invention to provide an apparatus and a method for detecting when an unvented fireplace system has begun to operate inefficiently or in a mode that has started to cause oxygen depletion build up long before any harmful effects can occur.

It is a principle object of the present invention to provide fireplaces which can selectively operate as an unvented high heat efficiency fireplace or as a vented high efficiency low heat fireplace.

It is yet another object of the present invention to provide a dual operable vented fireplace system that is operable as a hybrid fireplace system in both a vented and unvented dual mode of operation.

It is yet another object of the present invention to provide a method and means for automatically shutting down an unvented fireplace system when a catalytic converter needs cleaning or has become inoperable and needs replacement.

It is yet another object of the present invention to provide a dual operable fireplace system that permits operation in the most efficient mode of operation and may be reverted to a less efficient mode of operation by automatic or manual means.

According to these and other objects of the present invention, there is provided a novel method and fireplace for operation in a vented or unvented mode of operation. Exhaust gasses from the combustion chamber of the fireplace which would ordinarily be vented to an outside area are diverted from the exhaust path as a vented fireplace into a room to be heated for operation in an unvented mode of operation. The novel fireplaces are operable in a vented and/or unvented mode of operation by manual or automatic controls.

DETAILED DESCRIPTION OF THE PREFERRED EMBODIMENTS

Figure 1:
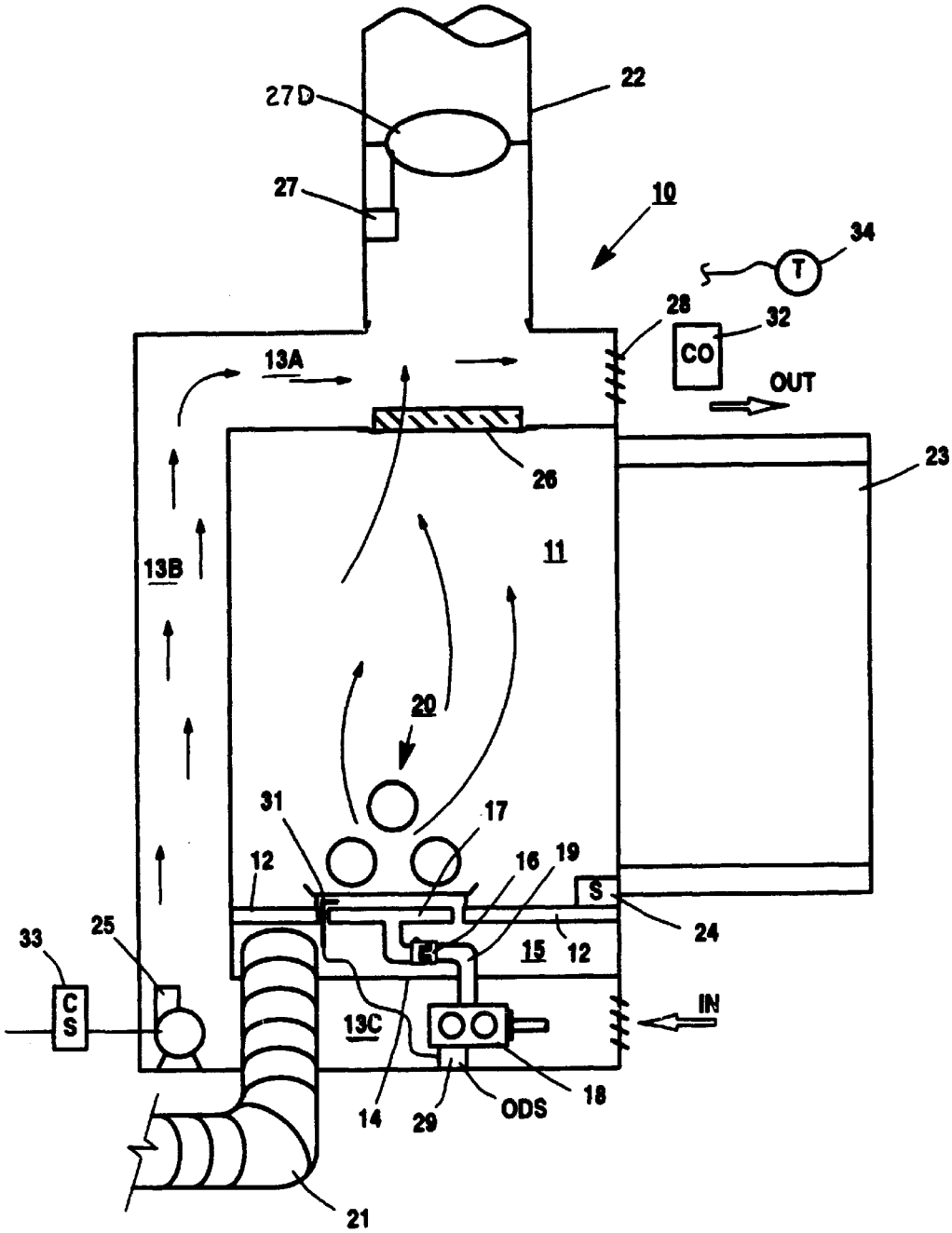
FIG. 1 is a side view in section of a preferred embodiment of the present invention showing a novel top vented fireplace with an outside fresh air supply operable in a vented or unvented dual mode of operation.

Refer now to FIG. 1 showing a side view in section of a novel top vented fireplace with a collinear fresh air supply that is capable of being operated in a vented or unvented or dual mode of operation. The fireplace 10 is schematically shown comprising a fireplace box 11 having a raised floor 12 and is surrounded by a heat exchanger 13 comprising passage ways 13A, 13B and 13C. The bottom panel 14 of the combustion box and the raised floor 12 form a combustion air plenum 15 in which is located the mixing valve 16 of the burner 17. A gas control valve 18 is located in the air passageway 13C and is connected by a gas connection pipe to the mixing valve 16. A fresh air duct or conduit 21 connects an outside source of combustion air to the combustion air plenum 15 so that no room air is required for the combustion products of the burner 17. There are several advantages to burning an independent source of outside air rather than room air. By burning outside air rather than room air, the pressure in the house is equalized. During cold weather, the outside air has substantially no moisture. Further, when room air is burned rather than outside air, the negative pressure generated causes cold outside air to filtrate into the room being heated. When the fireplace 10 is operated in the vented mode, the products of combustion pass up the exhaust stack 22 and carry with it the products of combustion which include as much as 1 gallon of water for every 100,000 BTU's of heat generated by burning gas. However, when the fireplace is operated and in an unvented mode and the products of combustion are dumped in the room to be heated, the excess moisture is deposited into the room. The moist air rises to the upper levels where it may condense and deposit in the attic area or even effect the structural elements of the house if a moisture barrier is not provided. Since fireplace 10 is designed to be operated in a top vented mode when the doors 23 are open, a switch 24 is provided so that the fan 25 is turned off when the doors are open. When the exhaust gasses from the burner 17 pass through the catalytic converter 26 into the exhaust stack 22 in the top vented mode, the bimetallic damper 27 operates the damper 27D to the open or least obstruction mode. However, when the doors 23 are closed and the fan 25 circulates room air through the heat exchanger 13, the room air passes over the catalytic converter and aspirates or sucks the hot exhaust gasses into the flow of room air and exits through the grill 28 and the fireplace 10 is operating in an unvented mode of operation. Since the fireplace is operable in an unvented mode of operation, it is provided with an oxygen depletion sensor 29 of the type which uses a bimetallic element (not shown) adjacent to the pilot 31. The mode of operation of such oxygen depletion sensors heat a bimetallic element which allows the gas flames to remain on. However, when the oxygen reaches a level around 16 to 17%, the flame flickers or even goes out so as to allow the element at the pilot 31 to close the gas valve 18, thus shutting off the burner 17. Since outside combustion air is supplied to the combustion air chamber 15, there is always an adequate supply of oxygen rich air at the burner pilot 31. Thus, the oxygen depletion sensor does not properly indicate the oxygen level of the room air. In order to overcome the short comings of the present oxygen depletion sensor, there is provided adjacent to or directly beside the outlet grill 25 a CO sensor 32. This sensor may be connected to one or two different points. In the preferred embodiment of the present invention, the CO sensor operates a switch which grounds the actuating signal used in the gas valve 18, thus shutting down the system. The advantage of using a CO detector in the path of the heated gas being supplied to the room should be apparent in that the CO level can be set at a level well above the oxygen depletion level and a level which is known to be safe for human occupancy in the adjacent room. In the preferred embodiment fireplace 10 shown in FIG. 1, the fireplace operates in an unvented mode of operation when the door 23 is closed. A further feature is that the blower motor 25 is provided with a control switch 33 which also has a rheostat speed control which can determine the amount of heated air and exhaust gas that is supplied to the room through grill 28. Thus, in a preferred mode of operation it is possible to set the blower motor 25 so that the CO detector 32 never reaches a low limit of oxygen depletion where the actual CO level can become harmful. Thus, it is better to sense the actual level of CO rather than to assume that the oxygen depletion level is a direct correlation factor thereof. When the fireplace 10 is operating in the unvented mode of operation, the damper 28 is substantially closed to avoid the down draft or aspiration of outside air down the stack 22 and into the room being heated.

In addition to setting the speed of the blower motor 25 using the control switch 33, it is possible to employ a remote thermostat 34 which can operate in one or two modes of operation depending on the control switch 33. It is possible to cycle the blower motor 25 on and off to maintain a desired thermostat setting or it is possible to adjust the rheostat in the control switch 33 and also control the temperature set at the thermostat 34. Another advantage of operating the fireplace 10 in an unvented mode with a CO detector 32 is that it will also detect when the catalytic converter 26 becomes inoperable or so dirty as to permit undesirable combustion byproducts to enter into the heat exchanger passageway 13A.

Having explained the operation of top vented fireplace 10, it should be understood that fireplaces of this type may be operated at thermal efficiencies of as high as 50% to 70% thermal efficiency. However, when operated in the unvented mode the thermal efficiency range is over 90%. It is possible to install fireplaces 10 in remote cabin areas for fast heating and fast start up conditions. For example, when first entering a cold cabin at extremely low temperatures, it is possible to start fireplace 10 in the unvented mode of operation and when the cabin becomes sufficiently warm to switch the mode of operation to a combination of vented and unvented modes of operation where the efficiency is below 90° but well above 50% without creating any harmful effects to the occupants of the cabin.

Figure 2:
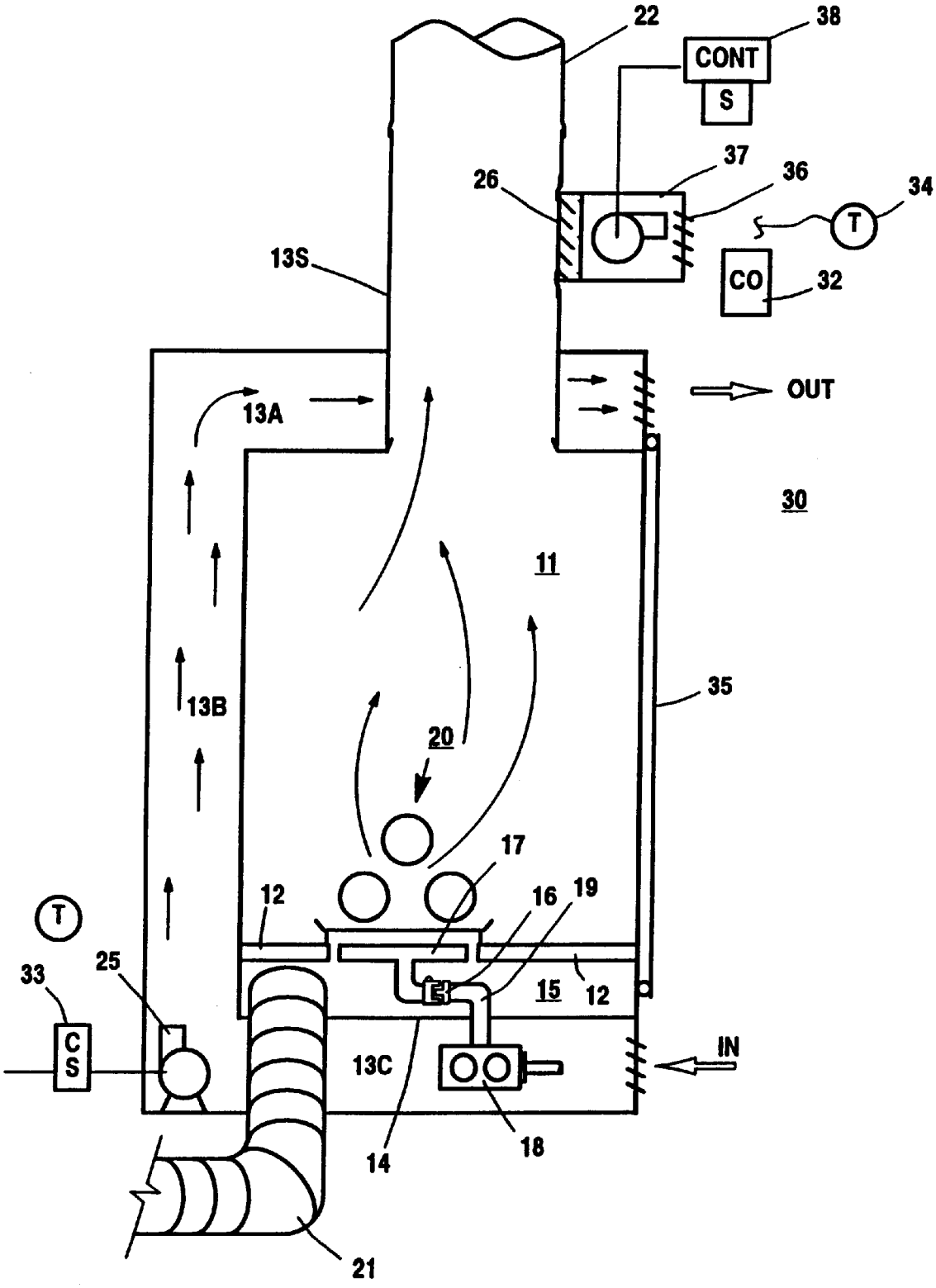
FIG. 2 is a side view in section of another preferred embodiment of the present invention showing a novel direct vented fireplace with a collinear fresh air supply that is operable in a vented or unvented or dual mode of operation.

Refer now to FIG. 2 showing a side view in section of a direct vented fireplace 30 having a collinear air supply 21. The fireplace 30 is provided with closed doors 35 and a modified heat exchanger 13 which includes a short vertical passageway 13S which connects to the exhaust stack 22. In this embodiment, a second blower motor 36 is shown connected to the heat exchanger 13S so as to divert exhaust gasses which are leaving the combustion box 11 on the way to the exhaust stack 22. When the blower means or blower motor 36 are actuated, exhaust gasses pass through the catalytic converter 26 and are directed through a duct or passageway 37 directly into the room area. Blower motor 36 is provided with a control switch 38 which preferably has a speed control rheostat. When the blower motor 36 is deactivated or off, the exhaust gasses pass to the outside area through the heat exchanger 13S and the exhaust stack 22. However, when the blower motor 36 is actuated, some of the exhaust gas is diverted into the room area to be heated and the fireplace 30 is operating in a partially unvented mode of operation. The aforementioned blower motor 25 and the new motor 36 comprise blower means for maximum efficiency operation of the fireplace 30. The blower motor 25 may be operated independently of the blower motor 36, thus a variety of modes of operation are possible when the speed control is provided on both motors 25 and 36. Direct vented fireplaces are designed for thermal efficiency operation around 70% and as explained hereinbefore the unvented fireplace may be operated at efficiencies up to and above 90%. In the preferred embodiment of the invention shown in fireplace 30, it is possible to operate the direct vented fireplace in a dual mode of operation at efficiencies between 70 and 90% without any harmful effect to the occupants of the room being heated. Since the numerals used on the elements in FIG. 2 are identical to and operate in the same mode of operation as those explained with reference to FIG. 1, additional explanation of these elements is not required.

Since the fireplace 30 is direct vented, it does not require an oxygen depletion sensor of the type employed in fireplace 10. The CO detector may be remote, however, placing the CO detector 32 close to the outlet of the passageway 37, it will detect the CO level of the gasses being supplied to the room to be heated. The detector 32 may be set to control the gas valve 18 to shut off well before any harmful CO levels are reached.

Figure 3:
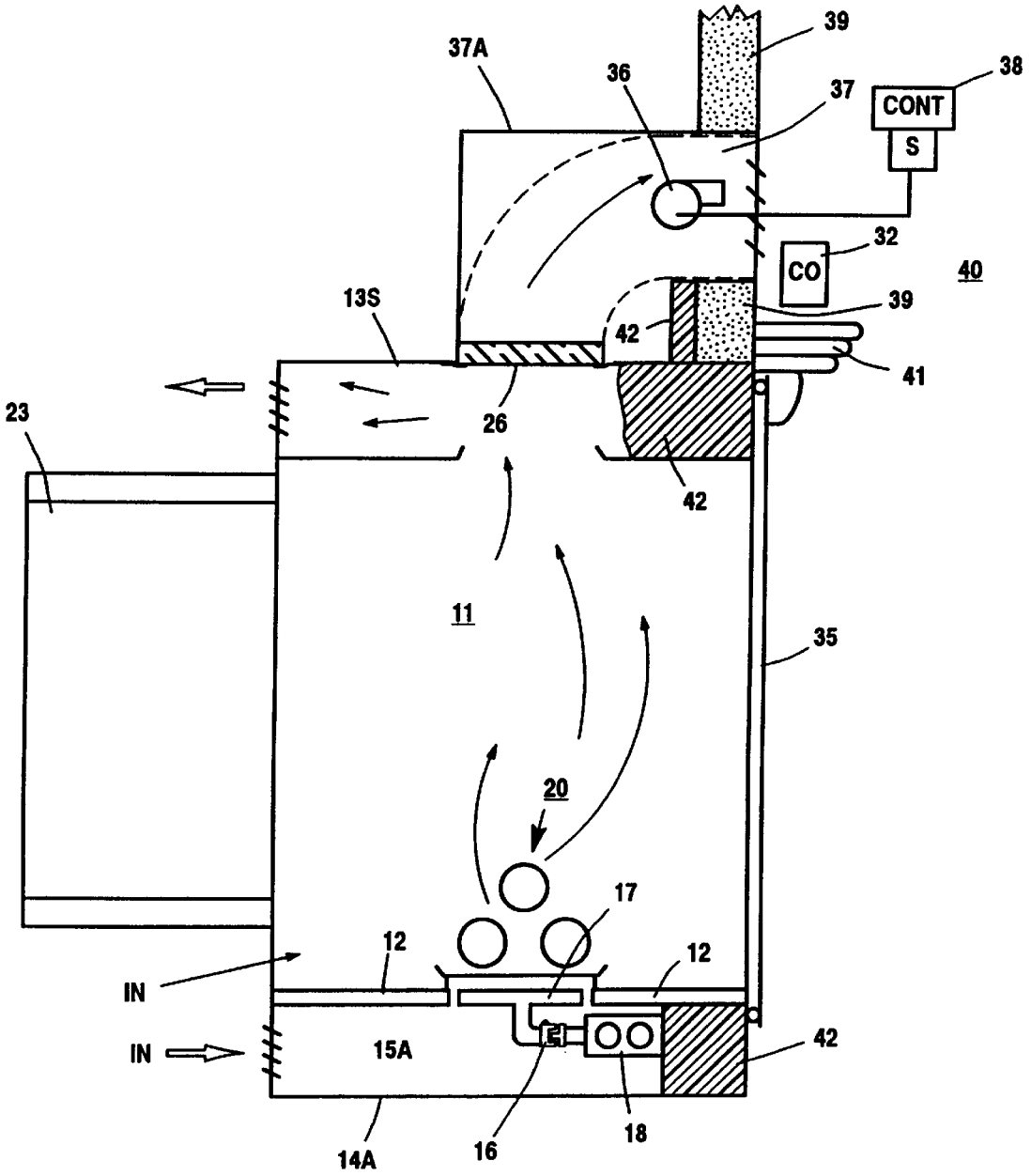
FIG. 3 is side view in section of a another preferred embodiment of the present invention showing a novel indoor/outdoor top vented fireplace with an outside fresh air supply operable in a vented or unvented or dual mode of operation.

Refer now to FIG. 3 showing a side view in section of a novel indoor/outdoor top vented fireplace having a fresh air supply of outside air which enters the combustion air plenum 15A from the outside. The door 23 is located on the outside and the door or glass closure 35 is located at an interior wall 39 below a decorative mantel 41. Thus it is possible to see through doors 23 and 35 of the fireplace 40 when standing in the room opposite the door 35. In this novel indoor/outdoor fireplace 40, the exhaust gasses enter into a special shaped heat exchanger 13S and passes the exhaust gasses directly out to the outside area without the need for a stack 22. The diversionary blower motor 36 may be located in a rectangular enclosure 37A or placed in a duct or passageway 37 as explained with reference to FIG. 2. The blower motor 36 comprises the diversionary blower means for diverting exhaust gasses from the heat exchanger 13S directly into the room to be heated when the fireplace 40 is operated in an unvented mode of operation. When the diversionary motor 36 is deactivated or off, the fireplace 40 operates in a vented mode of operation whether the door 23 is open or closed. In order to protect the external wall of the house of the room to be heated, insulation 42 is applied adjacent to to any material that could be heated in order to protect the wall or room.

In areas of the world and United States that are mild or substantially warm most of the year, it is highly desirable to install a fireplace of the type shown in FIG. 3 on the outside of the house and yet enjoy the aesthetic value of a gas fireplace without the penalty of introducing heat into the house area. However, during mildly cool times of the year, it is possible to use the fireplace 40 in an unvented mode of operation to heat the house or even the room area adjacent to door 35 at a highly efficient mode of operation. The numerals on FIG. 3 which are the same as those shown on FIGS. 1 and 2 are substantially identical structure and have the same mode of operation.

Figure 4:
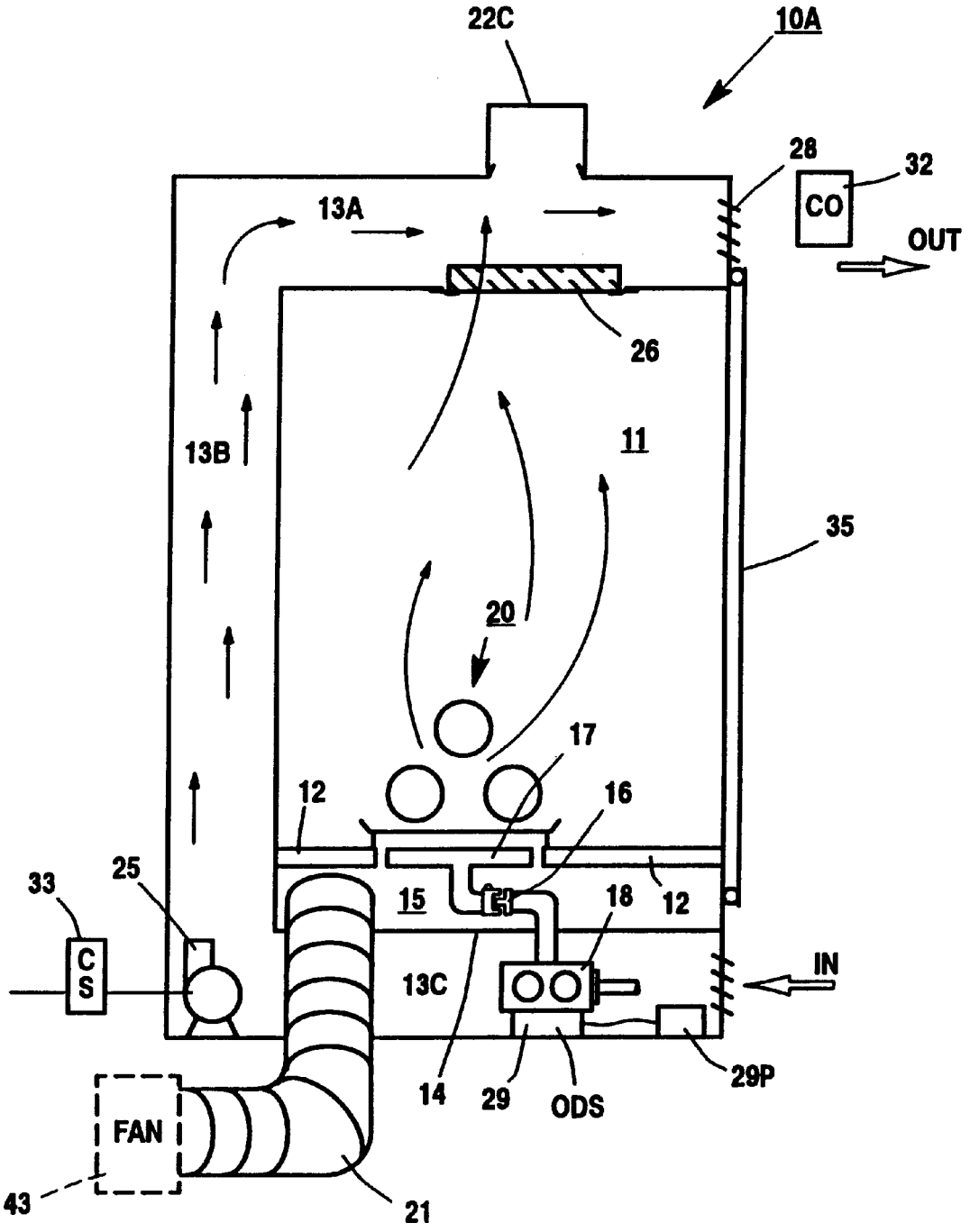
FIG. 4 is a side view in section of a preferred embodiment of the present invention showing a novel induced fresh air supply unvented fireplace adapted to be converted to a vented fireplace and is then operable in a vented or unvented or dual mode of operation.

Refer now to FIG. 4 showing a side view in section of a novel induced fresh air supply unvented fireplace adapted to be installed as an unvented fireplace but may be converted to a vented fireplace if needed. Fireplace 10A is similar to fireplace 10 of FIG. 1 in that they are both top vented or adapted to be top vented. Fireplace 10A is provided with a cap 22C which closes off the exhaust outlet aperture from the heat exchange 13A. In the preferred mode of operation, fireplace 10A is operated in an unvented mode wherein blower motor 25 passes room air over catalytic converter 26 and aspiration exhaust gasses leaving combustion chamber box 11 through the exhaust grill 28 where the exhaust gasses are sensed by CO detector 32 as explained hereinbefore. Again, it is possible to regulate control switch 33 and blower motor 25 to achieve a desirable heating effect into the room area to be heated. A pressure inducing fan 43 is shown as an optional fan for supplying outside fresh air to the combustion air plenum 15. Such pressure induced fans are desirable when the fresh to be introduced to the fireplace 10A includes or requires a long run. Also, the fan will induce or produce a positive pressure within the house being heated. Positive induced pressure fans increase the efficiency of heating of a leaky house in that the combustion air products are constantly being forced into the room under pressure and then room air leaks out rather than having cold air leak in.

It was explained with reference to FIG. 1 that there is a ANSI standard requiring oxygen depletion sensors of the type shown in FIG. 1 that employ bimetallic switch elements at the pilot 31. However, since FIGS. 1 and 4 are dual operable fireplaces which can be operated in a vented as well as an unvented mode, a new standard and a new sensor will be required for such novel fireplaces. In this regard, a new oxygen depletion sensor 29 is provided with a remote probe 29P which is placed in the intake of the heat exchanger passageway 13C so as to sense the oxygen level or oxygen depletion level of the room air being circulated through the heat exchanger 13. To assure that the novel unvented fireplace is completely safe for the occupants of the room being heated, the CO detector 32 is placed at the outlet grill 28 so as to detect any undesirable CO level of the room air and room exhaust gasses being passed through outlet grill 28 when operating in an unvented mode of operation. As explained hereinbefore, the CO detector 32 preferably shuts down the burner system for gas valve 18 when any level of CO is sensed such as occurs when the catalytic converter 26 becomes inoperable or dirty. In the preferred embodiment of the present invention, the Co detector 32 also shuts down any blower motor 25 or pressure induced fan 43 being operated. The dual mode fireplace 10A when operated in the unvented mode can be operated at thermal efficiencies of over 90%. If the fireplace 10A is operated as a top draft fireplace as shown in FIG. 1 it is preferred that the cap 22C be removed and a stack with a damper as shown in FIG. 1 be mounted thereon. Then, the mode of operation as explained with reference to FIG. 1 would be the same.

Figure 5:
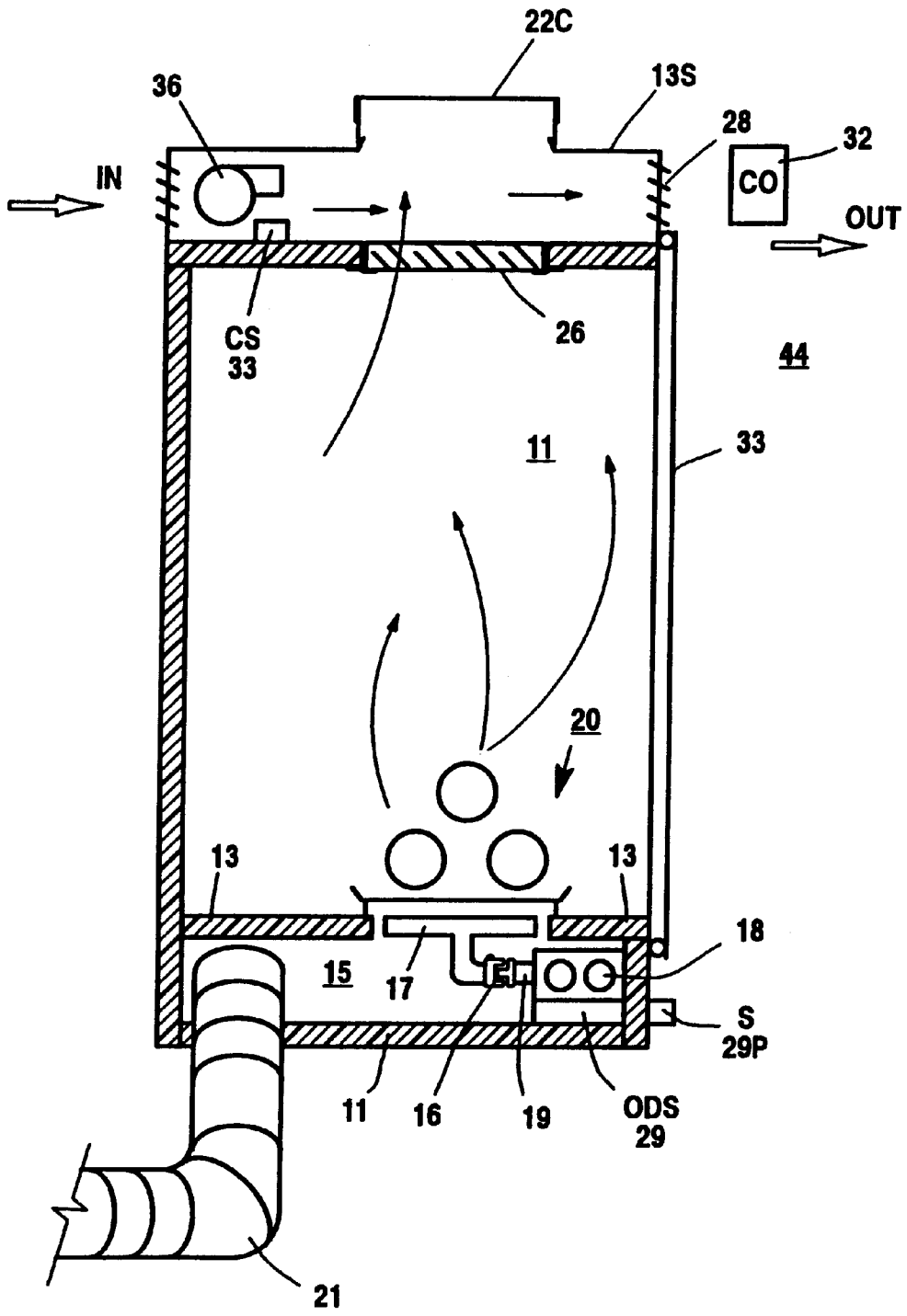
FIG. 5 is a side view and section of a preferred embodiment of the present invention showing a novel light weight reinforced ceramic fiber (RCF) combustion box with a collinear fresh air supply. The unvented fireplace is adapted to be operable in a vented or an unvented or dual mode of operation.

Refer now to FIG. 5 showing a side view in section of a novel light weight reinforced ceramic fiber (RCF) combustion chamber box 11 with a collinear fresh air supply 21 combined into a low cost novel fireplace 44 adapted to be operable in a vented or from an unvented mode as shown. Top vented fireplace 44 is provided with a cap 22C mounted over the outlet in the heat exchanger passageway 13S. In this embodiment, the combustion chamber box 11 is preferably a single unit molded reinforced ceramic fiber combustion chamber of the type shown and described in U.S. Pat. No. 5,941,237 filed Jan. 19, 1996 as docket RS-025. The fireplace 44 operates as a fresh air induced fireplace having a collinear duct supply 21 which terminates in combustion air chamber plenum 15. If the standard oxygen depletion sensor shown in FIG. 1 is employed there would never be a effective reading from oxygen depletion because of the fresh air being burned in the burner system 17. However, if the oxygen depletion sensor 29 is provided with an external probe or sensor 29P the sensor will read the oxygen depletion of the room air being heated. In the preferred embodiment of the present invention the blower motor 36 induces or aspirates exhaust gasses through catalytic converter 26 and exits them through grill 28 in an area where the CO detector 32 has been placed so that the hot exhaust gas mixture of room air and exhaust gasses is indicative of the maximum CO that can occur in the room air. The detector 32 is preferably connected to the gas valve 18 to shut down the complete burner system and motor 36 prior to a CO level reaching any level which could be harmful to the occupants of the room adjacent to the fireplace 44.

Having explained a preferred embodiment of the present invention provided in several types of fireplaces, it will be appreciated that the combustion box 11 shown in FIG. 5 could be floor mounted or mounted on a stand as explained in U.S. Pat. No. 5,941,237 which is incorporated by reference herein. As explained with reference to FIG. 4, it will be understood that the cap 22C can be removed and replaced by the stack system 22 shown in FIG. 1, then the fireplace 44 can then be operated in a top vented mode of operation by selectively activating the blower motor 36 to aspirate and divert exhaust gasses from the combustion chamber 11 into the room being heated.

Since the novel combustion chamber is preferably made from a light weight reinforced ceramic fiber that is very light an operates as an efficient insulator, the operating efficiency of fireplace 44 in an unvented mode will be superior to all fireplaces explained hereinbefore. A further advantage of the fireplace shown in FIG. 5 is that the maximum radiation effect is achieved in the direction opposite the door 33.

What is claimed is:

1. A dual operation vented/unvented gas fireplace, comprising:

a fireplace comprising heat exchanger means and a combustion chamber box, said combustion chamber box having five sides and a front side for receiving a glass door, a raised floor in said combustion chamber box forming a combustion air plenum below said raised floor and a chamber for gas combustion above said floor, inlet air means coupled to said combustion air plenum for introducing a source of outside air, gas burner means mounted in the floor of the gas combustion chamber at said floor, gas valve means coupled to said gas burner means for mixing a source of gaseous fuel with air in said combustion air plenum, exhaust opening means in the top of said combustion chamber box forming a passageway for burned hot exhaust gasses into said heat exchanger means, blower means mounted on said heat exchanger means for directing room air to be heated in one of said dual modes of operation, said blower means when activated being active to divert hot exhaust gasses directly into a room area to be heated, said blower means when not activated being passive to permit said hot exhaust gasses to pass through said heat exchanger means to an area outside of said room area, and means for activating and deactivating said blower means and for selecting said dual modes of operation.

2. A dual operation gas fireplace as set forth in claim 1 wherein said blower means is mounted in said heat exchanger means and the outlet air from said blower means is directed over said exhaust opening means for aspirating and mixing room air with hot exhaust gas diverted directly into a room area to be heated.

3. A dual operation gas fireplace as set forth in claim 1 wherein said blower means is mounted in said heat exchanger means and when not activated said exhaust gas is passed from said exhaust opening means into the heat exchanger means, and exhaust stack means coupled to said heat exchanger means juxtaposed said exhaust opening means for directing said exhaust gasses to said area outside of said room area to be heated.

4. A dual operation gas fireplace as set forth in claim 1 wherein the intake of said blower means is mounted in said heat exchanger means with the outlet air from said blower means directed into the room area to be heated, and said blower means being operable to divert said hot exhaust gasses from said exhaust opening means into said room area to be heated.

5. A dual operation gas fireplace as set forth in claim 4 wherein said heat exchanger means is mounted on top of said combustion chamber box, and said heat exchanger means having exhaust stack means for directing exhaust gasses to said area outside of said room area to be heated.

6. A dual operation gas fireplace as set forth in claim 5 wherein said exhaust stack means comprises a diversionary passageway coupled to the intake of said blower means for directing said hot exhaust gasses into said room area to be heated.

7. A dual operation gas fireplace as set forth in claim 1 wherein said heat exchanger means comprises a diversionary exhaust stack coupled to said exhaust opening means in said combustion chamber box for directing said hot exhaust gasses to an area outside of said room area, and said blower means is coupled to said diversionary exhaust stack of said heat exchanger means for diverting hot exhaust gasses into said room area to be heated.

8. A dual operation gas fireplace as set forth in claim 7 wherein said diversionary exhaust stack comprises a substantially vertical stack portion and a substantially horizontal stack portion coupled to the inlet of an induced draft fan.

9. A dual operation gas fireplace as set forth in claim 7 wherein said blower means comprises a first induced draft fan coupled to said diversionary exhaust stack, and a second fan in said heat exchanger for circulating room air to be heated through said heat exchanger, said first induced draft fan and said second fan being operable independent of each other.

10. A dual operation gas fireplace as set forth in claim 1 which further includes an operable glass door on the open front of said combustion chamber box, and switch means for sensing when said glass door is in an open position, said switch means being coupled to said blower means to deactivate diversion of said hot exhaust gasses directly into said room area to be heated when said glass door is open.

11. A dual operation gas fireplace as set forth in claim 1 which further includes thermostat means coupled to said blower means for activating said blower means to initiate diversion of said exhaust gasses directly into said room area to be heated until a predetermined temperature condition is reached.

12. A dual operation gas fireplace as set forth in claim 9 which further includes thermostat means coupled to said blower mean for controlling said first induced draft fan.

13. A dual operation gas fireplace as set forth in claim 12 wherein said thermostat means is further coupled to said second fan in said heat exchanger passageway.

14. A dual operation gas fireplace as set forth in claim 1 which further includes a catalytic converter mounted in said path of said exhaust gasses.

15. A dual operation gas fireplace as set forth in claim 14 wherein said catalytic converter is mounted in said heat exchanger means in the path of the diverted exhaust gasses.

16. A dual operation gas fireplace as set forth in claim 1 which further includes a carbon monoxide sensor (CO) coupled to said gas valve means for shutting off the gas being supplied when a predetermined safe CO level has been reached.

17. A dual operation gas fireplace as set forth in claim 1 which further includes an oxygen depletion sensor (ODS) having a remote probe for sensing $O_2$ levels remote from the fireplace.

18. A dual mode of operation gas fireplace, comprising:

a fireplace having a combustion chamber box and heat exchanger means for directing convection heated air into a room to be heated or to an outside area, burner means mounted in the floor of said combustion chamber box, a combustion air plenum underneath said burner means for supplying outside air to said burner means, said heat exchanger means being mounted on top of said combustion chamber box, exhaust opening means in the top of said combustion chamber box for conducting hot burned exhaust gasses from said combustion chamber box into said heat exchanger means for passage to said area outside of said room to be heated, and diversionary blower means coupled to said heat exchanger means for diverting hot burned exhaust gasses from said heat exchanger means and said combustion chamber box directly into said room to be heated for operation in a ventless mode of operation.

19. A dual operation gas fireplace as set forth in claim 18 wherein said diversionary blower means comprises means for controlling the amount of hot gasses being diverted from said exhaust opening means into said room for partial operation in a fresh air ventless induced mode of operation.

20. A method for operation of a gas fireplace in dual modes of operation, comprising the step of:

providing a gas fireplace having a combustion chamber box and heat exchanger means, mounting burner means in the floor of the combustion chamber box, providing outside air to a plenum under said burner means to produce hot exhaust gas products into said combustion chamber box, mounting said heat exchanger means on top of said combustion chamber box to receive said hot exhaust gas products and conduct said exhaust gas products to an outside air area, mounting diversionary blower means in said heat exchanger means, and diverting said hot exhaust gas products in said heat exchanger means from said combustion chamber into the room area to be heated in a ventless mode of operation.

21. The method as set forth in claim 20 wherein said step of diverting further comprises the step of only diverting a fractional portion of said hot exhaust gas products into said room area and conducting the remaining portion to said outside air area.

22. The method as set forth in claim 20 wherein the step of diverting comprises controlling the speed of a blower motor in said diversionary blower means so that said gas fireplace is operated in one of said dual modes of operation or alternatively in a vented and ventless mode of operation at the same time.

* * * * *